US007867001B2

(12) United States Patent
Ambo et al.

(10) Patent No.: US 7,867,001 B2
(45) Date of Patent: Jan. 11, 2011

(54) CONNECTION MEMBER AND HARNESS CONNECTOR

(75) Inventors: Tsugio Ambo, Kumagaya (JP); Yoshikazu Tanaka, Kumagaya (JP); Tomokazu Matsumoto, Kumagaya (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 0 days.

(21) Appl. No.: 12/520,980

(22) PCT Filed: Sep. 12, 2007

(86) PCT No.: PCT/JP2007/067717

§ 371 (c)(1),
(2), (4) Date: Nov. 11, 2009

(87) PCT Pub. No.: WO2008/081620

PCT Pub. Date: Jul. 10, 2008

(65) Prior Publication Data

US 2010/0062627 A1 Mar. 11, 2010

(30) Foreign Application Priority Data

Dec. 28, 2006 (JP) ..... 2006-354753
Dec. 28, 2006 (JP) ..... 2006-354754
Dec. 28, 2006 (JP) ..... 2006-354756

(51) Int. Cl.
*H01R 13/53* (2006.01)

(52) U.S. Cl. ..... 439/271; 439/274

(58) Field of Classification Search ..... 439/189, 439/271, 275, 274, 587, 589
See application file for complete search history.

(56) References Cited

U.S. PATENT DOCUMENTS 5,106,318 A 4/1992 Endo et al.
5,769,648 A * 6/1998 Hayashi ..... 439/206
5,788,519 A * 8/1998 Stern ..... 439/189
7,070,463 B2 * 7/2006 Arai et al. ..... 439/787

(Continued)

FOREIGN PATENT DOCUMENTS

JP 4-32175 A 2/1992

(Continued)

OTHER PUBLICATIONS

English Language International Search Report dated Oct. 16, 2007 issued in corresponding Appln. No. PCT/JP2007/067717.

*Primary Examiner*—T C Patel
*Assistant Examiner*—Phuong Nguyen
(74) *Attorney, Agent, or Firm*—Holtz, Holtz, Goodman & Chick, PC

(57) ABSTRACT

A waterproof harness connector that is simple, highly reliable, and can branch a wire. An inner holder is inserted into an outer holder from an opening, and then, joints of wire terminals, where seal members are attached to wires, are inserted into wire terminal holding holes of the inner holder through wire terminal insertion openings of the outer holder. When a pin terminal is inserted into pin terminal insertion hole of the inner holder, the pin terminal penetrates tubular contacts of the joints, which are placed in the holding hole, to electrically connect the wire terminals to each other. After that, a waterproof member is fixed to an opening to make the inside of the outer holder a waterproof structure.

19 Claims, 11 Drawing Sheets

U.S. PATENT DOCUMENTS

| | | | | |
|---|---|---|---|---|
| 7,294,008 | B2 * | 11/2007 | Fukuyama | 439/287 |
| 2009/0318002 | A1 * | 12/2009 | Murano et al. | 439/278 |

FOREIGN PATENT DOCUMENTS

| | | | |
|---|---|---|---|
| JP | 4-27587 | U | 3/1992 |
| JP | 9-147930 | A | 6/1997 |
| JP | 11-86998 | A | 3/1999 |
| JP | 2005-166523 | A | 6/2005 |

* cited by examiner

CONNECTION MEMBER AND HARNESS CONNECTOR

This application is a U.S. National Phase Application under 35 USC 371 of International Application PCT/JP2007/067717 filed Sep. 12, 2007.

FIELD OF THE INVENTION

The present invention relates to a connection member and a harness connector for use in harness circuits provided in, for instance automobiles.

BACKGROUND OF THE INVENTION

In a harness circuit for use in automobiles, it is often required to provide one or more branch electric wires from a main electric wire. Heretofore, there have been widely proposed two joint methods, i.e. a splice joint method in which a part of an electrically insulating sheath of the main electric wire is removed and one or more branch electric wires are connected by clamping them to an exposed core conductor of the main electric wire, and a joint connector method in which a circuit branch connector is arranged at a terminal of the main electric wire and conventional connectors having clamp terminals connected to the main wire and branch wires are inserted into the circuit branch connector to constitute the branch circuit. The later method is disclosed in a Japanese Patent Document 1 mentioned later.

Japanese Patent Document 1:

Japanese Utility Model Kokai Hei 4-27587

DISCLOSURE OF THE INVENTION

Problems to be Solved by the Invention

In the splice joint method, electric wires have to be connected to the main electric wire in such a manner that a group of one to three branch wires is connected by clamping, and therefore after connecting the branch wires, the harness is difficult to be handled. Moreover, the joint work could not be carried out on a manufacturing line, and therefore the splice joint method is not suitably applied to the line production.

The joint connector method has been developed to overcome the above mentioned drawbacks of the splice joint method. In the joint connector method, the joint connection can be performed on a harness manufacturing line, and therefore a production efficiency is superior to the splice joint method and a design change of harness circuit can be easily effected. However, the number of parts such as connectors, cooperating conventional connectors, bus bars, connection terminals and so on is increased, and thus a relatively longer time period is required for assembling harness circuits.

In the known branch circuit structure disclosed in the Japanese Patent Document 1, a plurality of terminal fittings accommodated within a housing are short-circuited by means of a single short-circuiting plate member.

However, the branch circuit structure disclosed in the Japanese Patent Document 1 has the following problems.

(1) Terminal fitting has complicated construction.

(2) The terminal fitting can be inserted only in one direction.

(3) Since the short-circuiting plate member has a plate shape, the short-circuiting plate member could not be smoothly mounted on the terminal fittings.

(4) The branch circuit structure as a whole has a relatively large width, and therefore the branch circuit structure could not be easily arranged in the harness circuit.

(5) A waterproof structure could not be easily realized.

That is to say, even the joint connector method has various problems to be solved. For instance, space saving of the harness circuit, improvement in workability, simplification of harness circuit structure and realization of waterproof internal structure are required.

The present invention has for its object to provide a connection member and a harness connector using the connector member, in which the above mentioned problems can be solved, a waterproof structure is attained, a simple manufacturing process is realized, and a wire harness can be assembled efficiently.

Merits of the Invention

In the connection member and harness connector according to the invention, an inner holder is inserted into an outer holder and a pin terminal is inserted into the inner holder via a wire terminal insertion hole formed in the outer holder, and therefore electric terminals can be electrically connected to each other within the inner holder and a reliability of the electrical connection and water proof property are improved and furthermore superior space factor, workability and cost reduction can be realized.

Moreover, the complicated construction is shared by the inner and outer holders, and therefore the connection member and harness connector can be easily manufactured.

Furthermore, the harness connector can be small in size, and thus the harness connector can be arranged at any desired position within the wire harness and a given circuit arrangement can be realized without extending electric wires. Particularly when the harness connector is used in the harness circuit for automobiles, the connection structure can be extremely simplified as compared with the known joint structures and the wire harness can be manufactured within a shorter time period.

EXPLANATION OF THE REFERENCE NUMERALS

Figure 1:
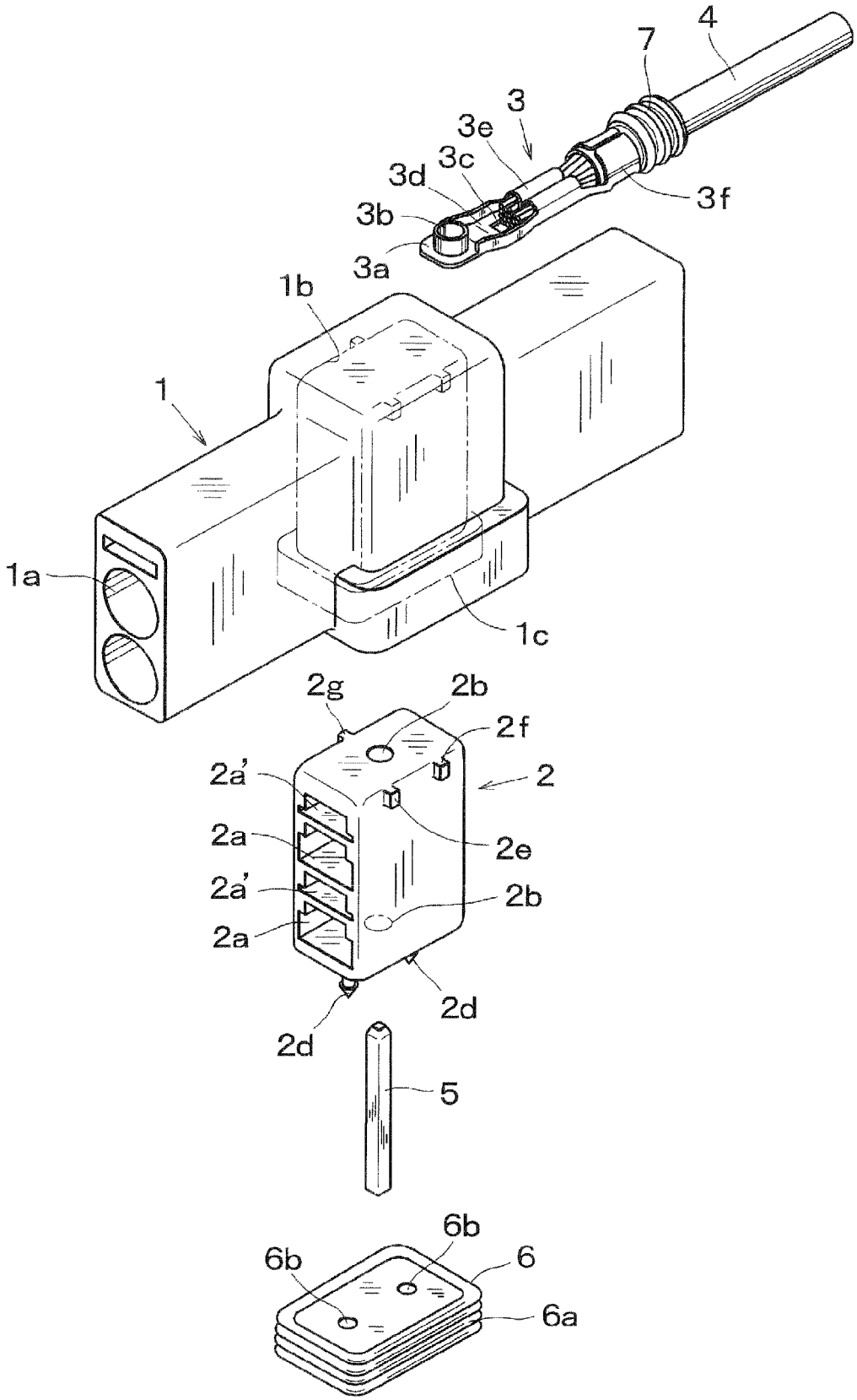
FIG. 1 is an exploded perspective view showing a first embodiment 1 of the harness connector according to the invention.

1 outer holder
1*a* wire terminal insertion opening
1*b* vacant space
1*c* opening
1*d* hinge
1*e* closing member
2 inner holder
2*a* wire terminal supporting hole
2*b* pin terminal insertion hole
2*c* engaging projection
2*d* locking projection
2*e*, 2*f*, 2*g*, 2*l* rib
2*h* movable supporting plate
2*i* locking claw
2*j* groove portion
2*k* operating tab
3 wire terminal
3*a* connecting portion
3*b* tubular contact
3*c* engaging hole
3*e* conductor clamping portion
3*f* sheath clamping portion
4 electric wire
5 pin terminal
6,8 waterproof member
6*a*, 8*a* corrugated portion
6*b* locking hole
7 sealing member

BEST MODES OF THE INVENTION

Now the present invention will be explained in detail with reference to embodiments shown in the drawings.

Embodiment 1

As shown in the exploded perspective view of FIG. 1, the harness connector of the present embodiment is mainly consisting of a rectangular outer holder 1 having a plurality of wire terminal insertion openings 1*a* formed therein; an inner holder 2 having wire terminal supporting holes 2*a* and a pin terminal insertion hole 2*b*; a plurality of wire terminals 3 each having a front end portion including a connecting portion 3*a* having a tubular contact 3*b* and a rear portion having an electric wire 4 connected thereto; a pin terminal 5; and a waterproof member 6 made of synthetic rubber.

The outer holder 1 has a plurality of wire terminal insertion openings 1*a* having a circular cross section, said wire terminal insertion openings extending from both end walls of the outer holder toward its center. In the present embodiment, in each of the end walls of the outer holder 1, there are formed two wire terminal insertion openings 1*a*. The outer holder 1 further includes a vacant space 1*b* into which the inner holder 2 is to be inserted from an inner holder insertion opening 1*c* formed in a bottom of the outer holder 1.

The outer holder 1 may be made of, for example a thermoplastic resin, and particularly polybutylene terephthalate (PBT) and polypropylene (PP) may be advantageously used due to their superior properties such as a high heat distortion temperature, a high mechanical rigidity, a high electrical insulation and high mechanical performances. A size of the outer holder 1 may be suitably determined, while considering the number of and thickness of the electric wires to be used. A length of the outer holder 1 is usually set to about 20-150 mm. In general, the outer holder 1 may be manufactured by injecting a thermoplastic resin into a suitable mold.

Figure 2:
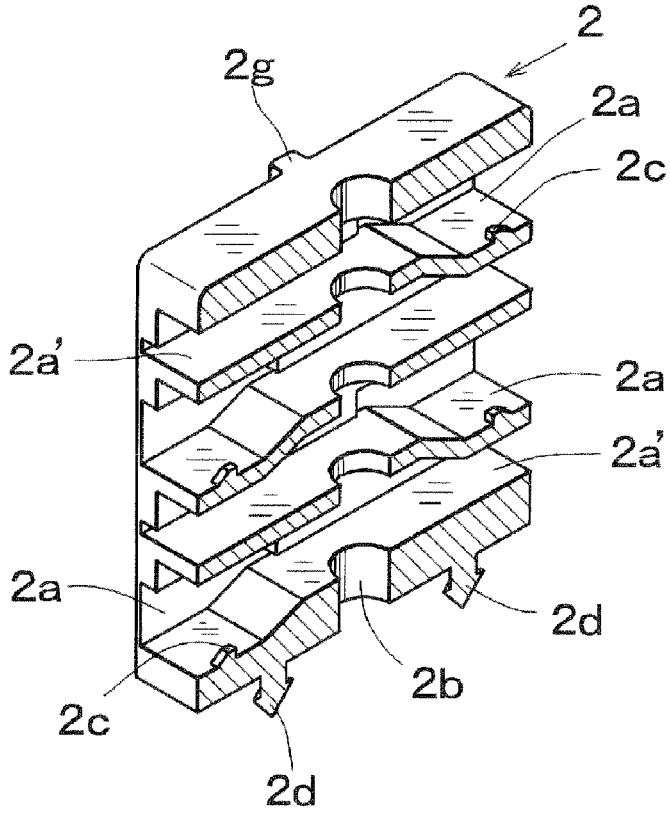
FIG. 2 is a perspective view illustrating an inner holder, while a part of the inner holder is cut away.

The inner holder 2 has a substantially cubic shape and includes the wire terminal supporting holes 2*a* as shown in a cross sectional view of FIG. 2. The wire terminal supporting holes 2*a* are communicated with the wire terminal insertion openings 1*a*, when the inner holder 2 is inserted into the outer holder 1. In this condition, the wire terminals 3 may be inserted into the wire terminal supporting holes 2*a* through the wire terminal insertion openings 1*a* of the outer holder 1. In FIG. 2, a reference numeral 2*a*' denotes an opening which is opposed to an opening of the wire terminal supporting hole 2*a* from which the wire terminal is inserted. On a bottom of the wire terminal supporting hole 2*a* there is formed an engaging projection 2*c* which is to be engaged with the inserted wire terminal 3, said engaging projection 2*c* also serving to prevent an erroneous insertion of the wire terminal 3 into the inner holder 2 from the opening 2*a*'.

The pin terminal insertion hole 2*b* is formed in a vertical direction such that the pin terminal insertion hole 2*b* is communicated with the wire terminal supporting holes 2*a* within the inner holder 2. On a bottom of the inner holder 2 there are formed a plurality of hook-like locking projections 2*d* for locking the waterproof member 6 within the inner holder 2.

On one side wall of the inner holder 2, there are formed two ribs 2*e* and 2*f* and on the other side wall of the inner holder 2, there is formed a single rib 2*g*. In the vacant space 1*b* formed in the outer holder 1, there are formed recesses into which the ribs 2*e*, 2*f* and 2*g* are inserted when the inner holder 2 is inserted into the vacant space 1*b* of the outer holder 1.

The inner holder 2 may be made of a same material as the outer holder 1, but since the inner holder 2 is inserted within the outer holder 1, the inner holder 2 may be made of a material which does not have a heat resistance, although the outer holder 1 is required to have a heat resistance. The inner holder 2 may be formed by the injection mold, but when the inner holder 2 has a complicated inner structure, it may be divided into plural parts and these parts may be separately manufactured. Upon assembling, these parts may be united by cementing or engagement to form the inner holder.

The wire terminal 3 is formed by punching an electrically conductive metal plate, and includes a tongue-like connecting portion 3*a* provided at one end portion of the wire terminal, an inclined portion 3*d* and a conductor clamping portion 3*e* and a sheath clamping portion 3*f* provided at the other end portion of the wire terminal. In each of the connecting portion 3*a*, there is formed a short tubular contact 3*b* extending in a direction perpendicular to a plane of the connecting portion 3*a* and an engaging hole 3*c* which is to be engaged with the engaging projection 2*c* of the inner holder 2. Said tubular contact 3*b* is formed by a reducing mill into a cylindrical shape having a short length.

The electric terminal 3 may be formed by punching a copper or copper alloy plate or a Sn plated copper or copper alloy plate. A brass plate may be advantageously used due to its superior mechanical strength and electrical conductivity. When use is made of a Sn plated brass plate, an anticorrosion property is improved and a good electrical contact can be attained with respect to the pin terminal 5.

Figure 3:
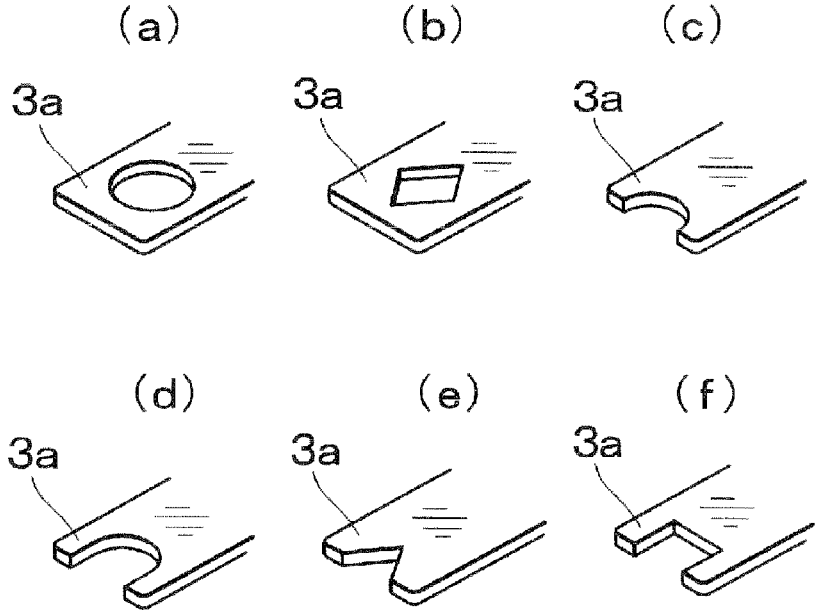
FIG. 3 is a perspective view depicting a modification of a wire terminal.

The tubular contact 3*b* may have any suitable shape as long as a good electrical conduction can be attained when the contact 3*b* is brought into contact with the pin terminal 5. It is preferable to provide tapered guides both at a root portion and a front portion of the tubular contact 3*b* such that the pin terminal 5 can be easily inserted into the tubular contact 3*b* from either directions. In the present embodiment, the contact 3*b* is formed as a tubular shape, but it may be formed to have other shape than tubular. For instance, the contact 3*b* may be formed into various shapes as shown in FIG. 3, (a) circular shape, (b) polygonal shape, or a cut-out having various shapes such as (c) semicircular shape, (d) U-shape, (e) V-shape, and (f) rectangular shape. In view of the conductivity and durability of the contact, it is preferable to form the contact 3*b* as the tubular contact.

The electric wire 4 may be formed by an electrically insulated wire having a conductor and an electrically insulating sheath applied around the conductor and may have a conventional diameter. The conductor may be formed by a stranded wire of soft or hard copper wires which have been commonly used in automobile harnesses, or may be formed by a single wire or a stranded wire of copper alloy wires such as Cu—Sn alloy wire having a sufficiently large tensile strength and a small diameter. The electrically insulating sheath may be made of known electrically insulating materials. In view of environment protection, non-halogen insulating material may be advantageously used.

The conductor of the electric wire 4 may be connected to the wire terminal 3 by conventional caulking, welding, soldering or clamping. Among these connecting methods, the clamping portion 3*e* used in the present embodiment is preferable, because the clamping connection can be performed within a short time period and can attain a high electrical conductivity and a higher mechanical strength.

The pin terminal 5 is inserted into the pin terminal insertion hole 2*b* formed in the inner holder 2 and serves to electrically connect a plurality of the connecting portions 3*a* of the wire terminals 3 to one another. To this end, the pin terminal 5 is formed by a rod-like member made of an electrically conductive metal and having a circular cross sectional shape or a polygonal shape such as triangular shape, rectangular shape and pentagonal shape. It should be noted that the rectangular cross sectional shape is preferable, because the pin terminal 4*a* having the rectangular cross sectional shape can be easily manufactured, can be inserted into the pin terminal insertion hole 2*b* without a large force, and can attain a stable and positive conduction. In this case, the contact of the wire terminal 3 may be preferably formed to have tubular or circular shape.

Figure 4:
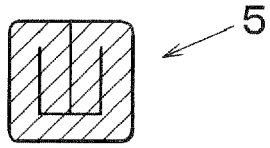
FIG. 4 is a cross sectional view showing a pin terminal.

The pin terminal 5 is formed by folding an electrically conductive plate into a rectangular cross sectional shape as depicted in FIG. 4. Then, a top end of the pin terminal 4 is sharpened by pressing or cutting. In this manner, although use is made of the pin terminal 5 having a small cross sectional area, the pin terminal 5 can be protected against bending and break-down.

It is preferable to form the pin terminal 5 to have a higher hardness than the connecting portion 3*a*, and then the connecting portion 3*a* of the wire terminal 3 is deformed upon insertion of the pin terminal 5. Hardness of the pin terminal 5 and connecting portion 3*a* may be suitably adjusted by processing, thermal treatment and selection of materials. In order to insert the pin terminal 5 into the tubular contact 3*b* positively, the tip of the pin terminal 5 is preferably formed to have a cone shape such as circular cone, pyramid cone, cone frustum and pyramid frustum.

Now it is assumed that the circular or tubular contact of the connecting portion 3*a* has an inner diameter of d1 and the pin terminal 5 having a substantially rectangular cross section has a diagonal length of x, then it is preferable to set d1<x. Further, when the connecting portion 3*a* includes the contact having a rectangular cross section having a side of d1 and the pin terminal 5 has a circular cross section having an outer diameter of d2, then it is preferable to set d1<d2.

The waterproof member 6 is formed to have a cubic shape which is just fit into the inner holder insertion opening 1*c* of the outer holder 1. On an outer surface of the waterproof member 6 there is formed a corrugated portion 6*a*. In a top surface of the waterproof member 6 there are formed locking holes 6*b* into which the locking projections 2*d* of the inner holder 2 are inserted.

Figure 5:
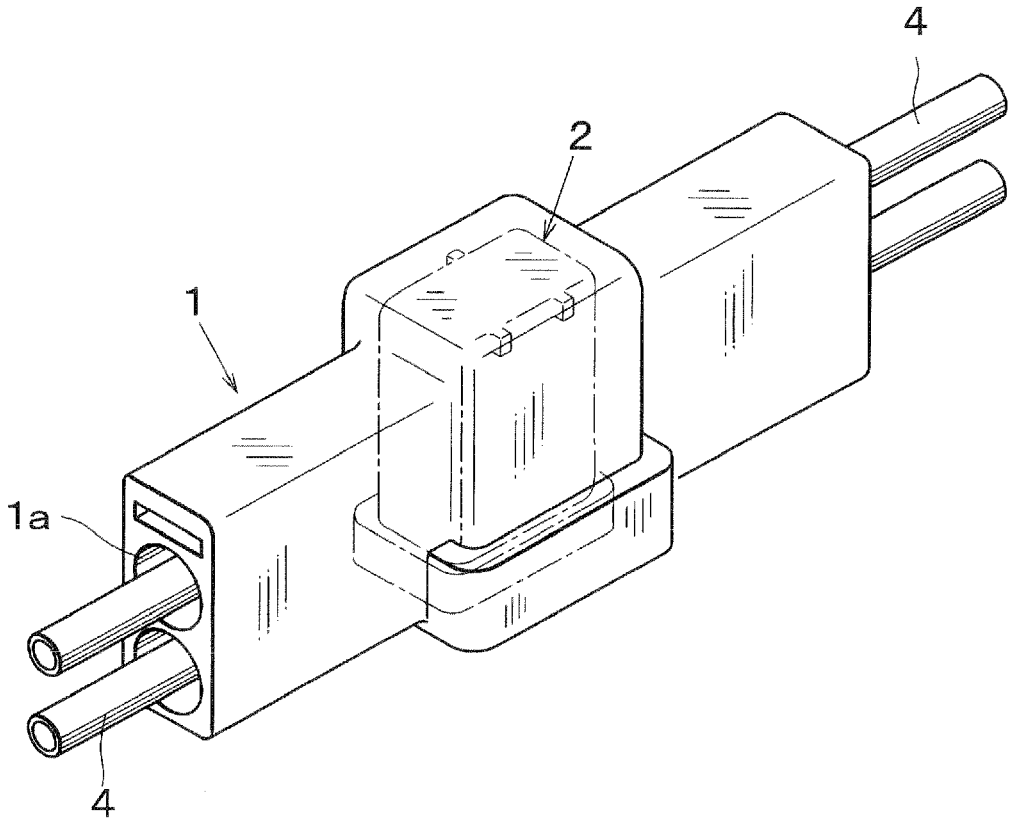
FIG. 5 is a perspective view representing an assembled condition of the harness connector.
Figure 6:
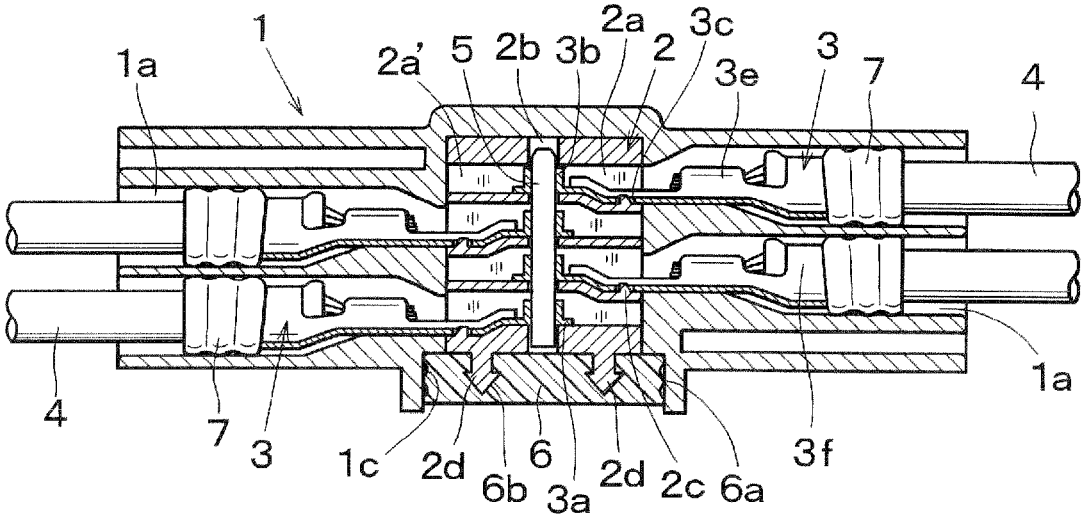
FIG. 6 is a longitudinal cross sectional view showing the harness connector.

FIG. 5 is a perspective view and FIG. 6 is a cross sectional view showing the assemble condition. At first, the inner holder 2 is inserted into the vacant space 1*b* of the outer holder 1. This inserting operation is carried out such that the asymmetrically arranged ribs 2*e*, 2*f* and 2*g* are correctly fit into the recesses in the vacant space 1*b*, and therefore an erroneous insertion can be effectively prevented. Next, the four wire terminals 3 are inserted into the inner holder 2 through the four wire terminal insertion openings 1*a* of the outer holder 1 such that the engaging projections 2*c* of the inner holder 2 are inserted into the engaging holes 3*c* of the wire terminals 3. In this manner, the wire terminals 3 are fixed at given positions, and a center of each of the tubular contacts 3*b* of the connecting portions 3*a* is aligned with a center of the pin insertion hole 2*b* of the inner holder 2.

In the present embodiment, the engaging projections 2*c* of the inner holder 2 are formed to be fixed, but the engaging projections 2*c* may be formed on movable levers so as to move up and down. Then, upon insertion of the wire terminal 3, the movable lever is moved downward and the engaging projection 2*c* can be easily inserted into the engaging hole 3*c* of the wire terminal 3. Furthermore, after pulling the pin terminal 5 out of the pin terminal insertion hole 2*b*, the engaging projection 2*c* can be easily removed from the engaging hole 3*c* by moving the movable lever upwardly by means of a suitable jig and the wire terminal 3 can be removed from the outer and inner holders 1 and 2.

Also in the present embodiment, since the tubular contacts 3*b* of the connecting portions 3*a* are stacked within the inner holder 2, in order to avoid interference between the tubular contacts 3*b* of the connecting portions 3*a* inserted from one end wall of the outer holder 1 and the tubular contacts 3*b* of the connecting portions 3*a* inserted from the other end wall of the outer holder 1, the wire terminal insertion openings 1*a* formed in one end wall of the outer holder 1 are shifted in the vertical direction with respect to the wire terminal insertion openings 1*a* formed in the other end wall of the outer holder 1. When the wire terminal 3 is inserted into the outer holder 1 and inner holder 2, the sealing member 7 is intimately brought into contact with an inner wall of the wire terminal insertion opening 1*a*, and penetration of water from the external can be prevented.

Since the tubular contacts 3*b* are provided on the connecting portions 3*a*, it is important to insert the connecting portions 3*a* into the wire terminal insertion openings 1*a* such that the tubular contacts 3*b* extend in a correct direction. If the connecting portions 3*a* are inserted such that the tubular contacts 3*b* extend in arbitrary direction, the connecting portions 3*a* could not be situated in given positions within the inner holder 2. Therefore, it may be necessary to provide suitable indications in terms of a direction of the tubular contacts 3*b* at entrances of the wire terminal insertion openings 1*a*.

When the pin terminal 5 is inserted into the pin terminal insertion hole 2*b* using a suitable jig, the pin terminal 5 passes through the tubular contacts 3*b* of the inserted wire terminals 3 and are brought into contact with the tubular contacts 3*b*, and the wire terminals 3 are electrically connected to one another. As long as the pin terminal 5 is not removed from the pin terminal insertion hole 2*b*, the wire terminals 3 could not be removed from the outer and inner holders 1 and 2.

Furthermore, when the waterproof member 6 is inserted into the opening 1*c*, the locking projections 2*d* of the inner holders 2 are inserted into the locking holes 6*b* formed in the waterproof member 6 and the waterproof member 6 could not be removed from the outer holder 1. Moreover, the corrugated portion 6*a* of the waterproof member 6 serves to prevent undesired penetration of water into the outer holder 1. The opening 1*c* of the outer holder 1 may be closed by a plate-like member made of synthetic resin to further improve the waterproof property provided by the water proof member 6.

In the embodiment 1 having the structure so far explained, the penetration of water into the outer holder 1 can be effectively prevented by means of the waterproof member 6 and the sealing members 7 provided on the electric wires 4. In this manner, the waterproof structure within the harness connector can be attained.

Embodiment 2

Figure 7:
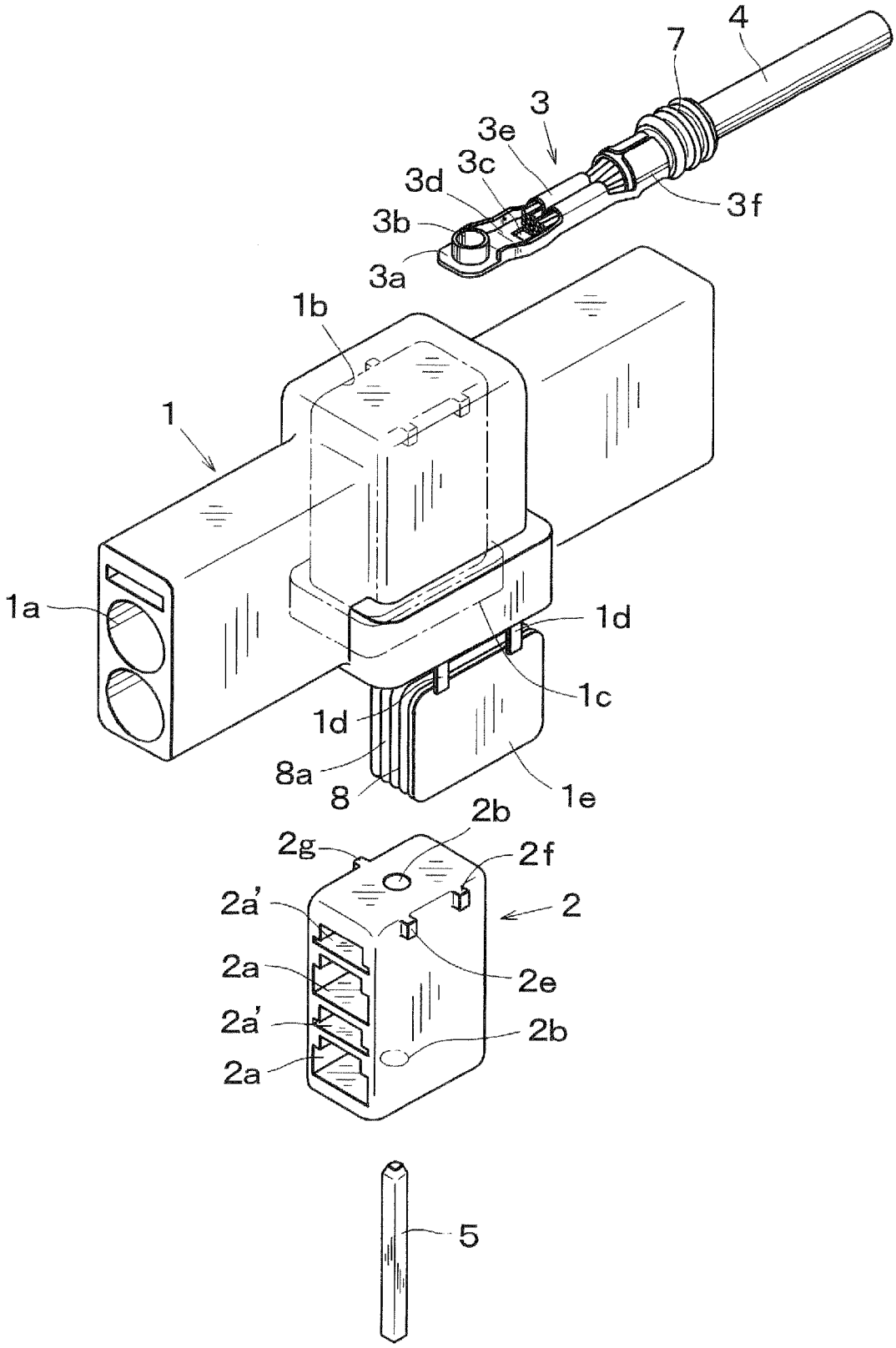
FIG. 7 is an exploded perspective view illustrating a second embodiment 2 of the harness connector.

FIG. 7 is an exploded perspective view showing a second embodiment 2 of the harness connector according to the invention, said harness connector comprising an outer holder 1, an inner holder 2, wire terminals 3, a pin terminal 5 and a waterproof member 8.

In this second embodiment 2, the inner holder 2, wire terminals 3 and pin terminal 5 are substantially identical with those of the first embodiment 1, but a closing member 1*e* for closing an opening is of the outer holder 1 is rotatably secured to the lower portion of the outer holder 1 by means of hinges 1*d* and the waterproof member 8 including a corrugated portion 8*a* is secured to an inner surface of the closing member 1*e* by locking or cementing. Although not shown in the drawings, a locking mechanism is provided on the closing member 1*e* and opening 1*c* such that the closing member 1*e* might not be accidentally opened.

Figure 8:
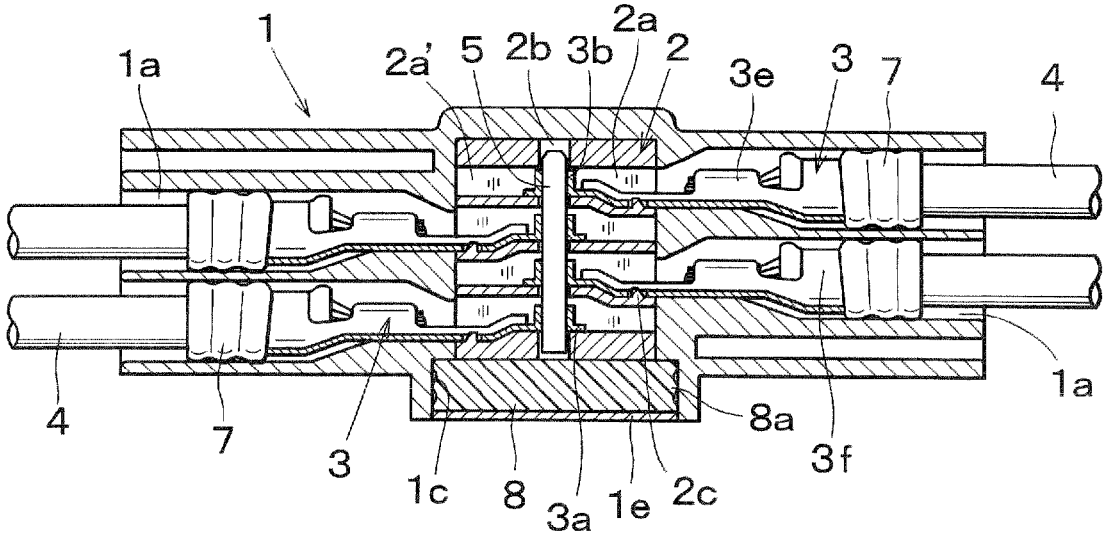
FIG. 8 is a longitudinal cross sectional view showing the harness connector.

As illustrated in FIG. 8, when the waterproof member 8 is inserted into the opening 1*c* and the opening 1*c* is closed by the closing member 1*e* by turning the closing member 1*e* about the hinges 1*d*, the corrugated portion 8*a* of the waterproof member 8 can effectively prevent water penetration from the external into the outer holder 1. Like as the first embodiment 1, sealing members 7 are provided around to prevent water penetration into the outer holder 1 along the wire terminals 3.

Embodiment 3

Figure 9:
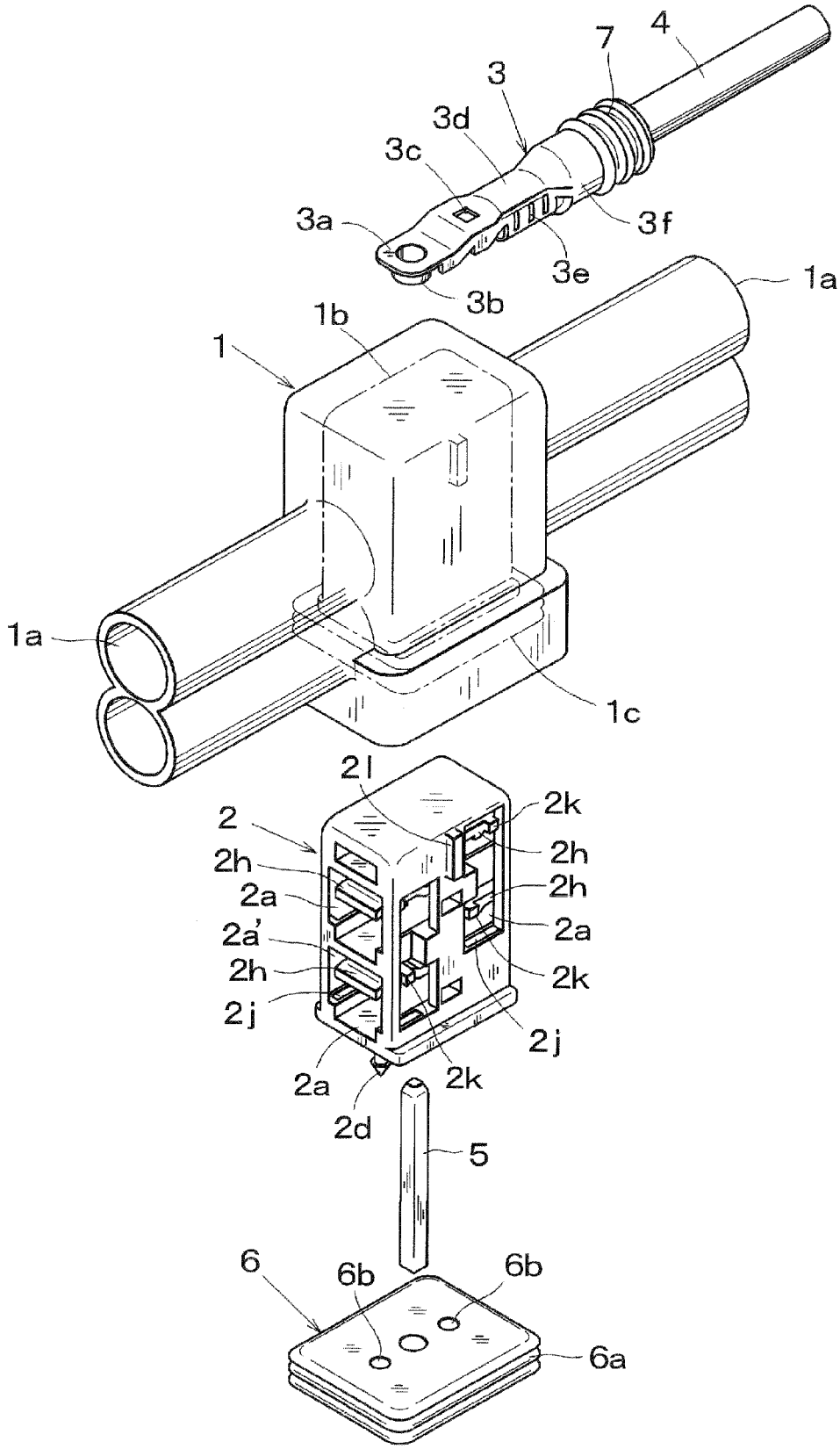
FIG. 9 is an exploded perspective view illustrating a third embodiment 3 of the harness connector.

FIG. 9 is an exploded perspective showing a third embodiment 3 of the harness connector according to the invention. The harness connector comprises a cubic outer holder 1 having a plurality of wire terminal insertion openings 1*a* each consisting of a tubular member, an inner holder 2 including wire terminal supporting holes 2*a* and a pin terminal insertion hole 2*b*, a plurality of wire terminals 3 and a waterproof member 6 made of a synthetic rubber.

Figure 10:
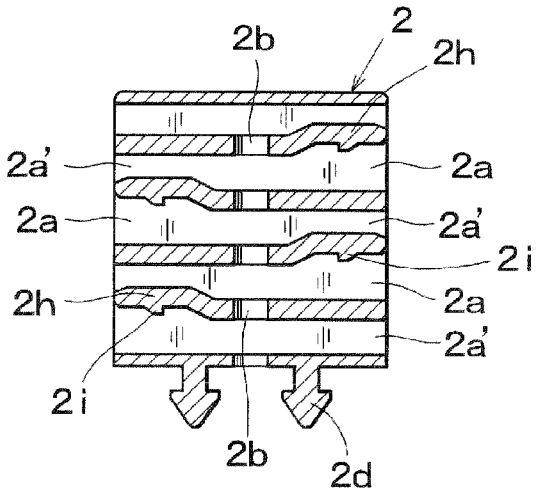
FIG. 10 is a cross sectional view depicting the inner holder.

The outer holder 1 of this embodiment 2 has a similar shape to the outer holder 1 of the first embodiment 1, but the inner holder 2 of the present embodiment 2 is formed substantially as a cubic body having a structure depicted in a cross sectional view of FIG. 10. The inner holder 2 includes wire terminal supporting holes 2*a* extending horizontally, said wire terminal supporting holes 2*a* being communicated with the wire terminal insertion openings 1*a* when the inner holder 2 is inserted into the vacant space 1*b* formed within the outer holder 1, and said wire terminal supporting holes 2*a* supporting the connecting portions 3*a* of the wire terminals 3 when the wire terminals are inserted into the inner holder 2 through the wire terminal insertion openings 1*a*. The inner holder 2 further includes the pin terminal insertion hole 2*b* extending vertically, said pin terminal insertion hole 2*b* intersecting the wire terminal supporting holes 2*a* within the inner holder 2. It should be noted that a reference numerals 2*a*' denotes an opening of the wire terminal supporting hole 2*a* opposite to an opening from which the wire terminal 3 is inserted into the wire terminal insertion hole. Above the wire terminal supporting holes 2*a* there are formed movable supporting plates 2*h*, and locking claws 2*i* are formed on rear surfaces of the movable supporting plates 2*h*, said locking claws 2*i* serving to fix the wire terminals 3 in position.

In the inner holder 2 there are formed slot portions 2*j* at both ends near the inlet openings of the wire terminal supporting holes 2*a*. A suitable jig may be inserted into the inner holder 2 through said slot portions 2*j* to move the movable supporting plates 2*h* upward. On both sides of respective movable supporting plates 2*h* there are formed operating tabs 2*k* extending outwardly. Positions of the operating tabs 2*k* provided on the vertically arranged movable supporting plates 2*h* are shifted horizontally.

Furthermore, on the bottom surface of the inner holder 2 there are formed two hook-like locking projections 2*d* for locking the waterproof member 6 in position. On one side of the inner holder 2 there is formed a rib 2*l*, and a recess corresponding to said rib 2*l* is formed in an inner surface of the vacant space 1*b* into which the inner holder 2 is to be inserted.

Figure 11:
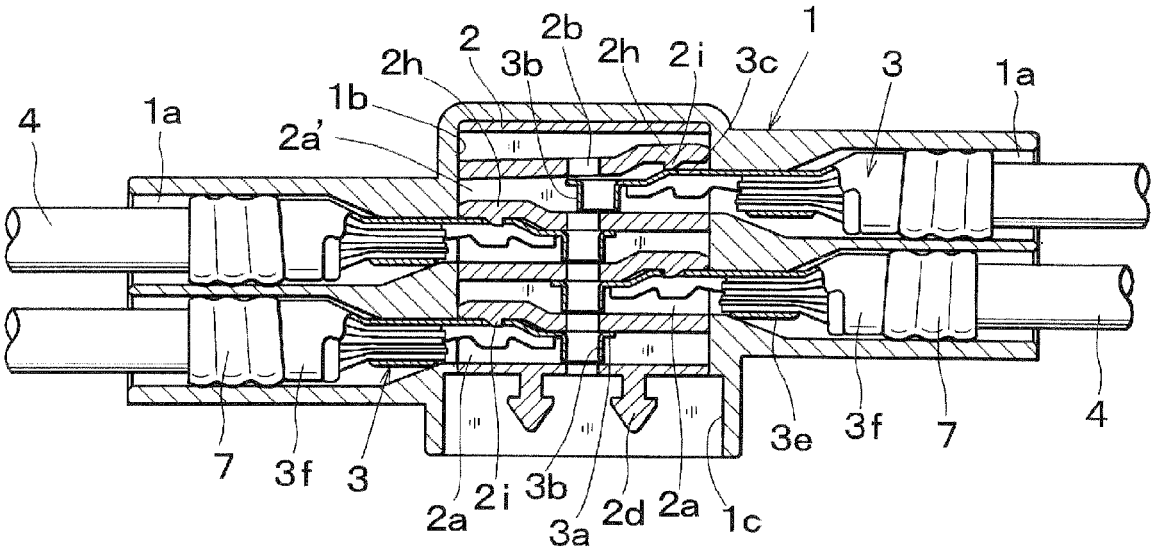
FIG. 11 is a cross sectional view showing the harness connector during the assembling.

FIG. 11 is a cross sectional view showing an assembled condition. When the inner holder 2 is inserted into the vacant space 1*b* of the outer holder 1, the inner holder 2 is locked at position by means of a suitable locking mechanism not shown in the drawings. During this inserting operation, the rib 2*l* formed asymmetrically on one side wall of the inner holder 2 is snapped into the recess formed in the vacant space 1*b*, and therefore undesired insertion of the inner holder 2 into the outer holder 1 can be prevented.

Next the wire terminals 3 are inserted into the four wire terminal insertion openings 1*a* of the outer holder 1. During this insertion operation, as shown by the upper right wire terminal 3 in FIG. 12, the connecting portion 3*a* pushes the movable supporting member 2*h* upwardly and is further inserted into the inner holder 2. Then, the locking claw 2*i* of the inner holder 2 is inserted into the engaging hole 3*c* and the movable supporting plate 2*h* moved downward as illustrated by the lower right wire terminal 3 in FIG. 12. In this manner, the wire terminal 3 is fixed at given position and the center of the tubular contact 3*b* of the connecting portion 3*a* is aligned with the center of the pin terminal insertion hole 2*b*.

Figure 12:
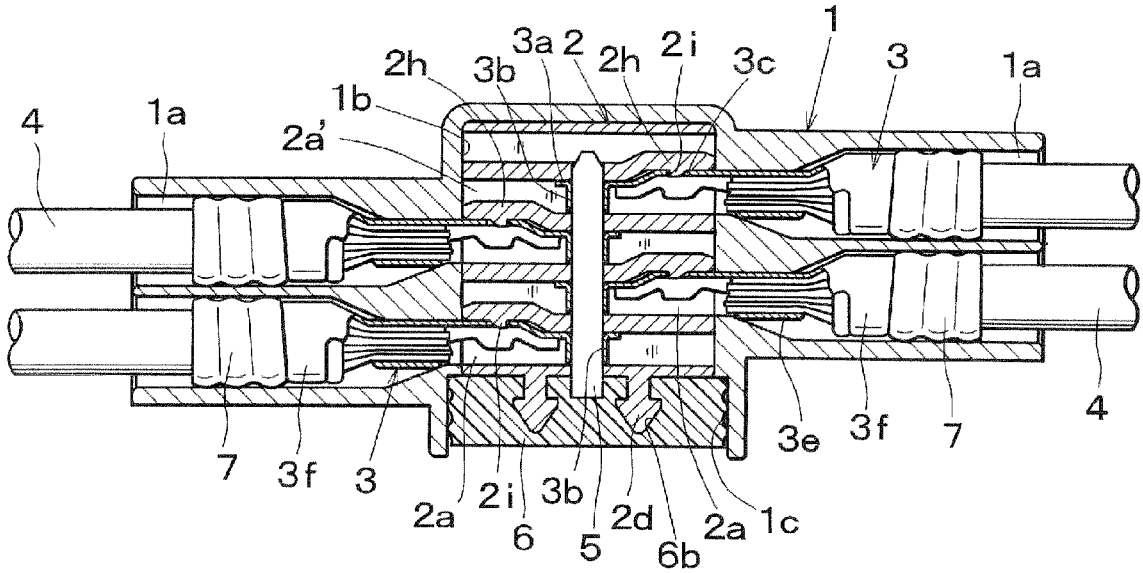
FIG. 12 is a cross sectional view illustrating the assembled harness connector.

After inserting all the wire terminals 3, as depicted in FIG. 12, the pin terminal 5 is inserted into the pin terminal insertion hole 2*b* using a suitable inserting jig such that the pin terminal 5 passes through the tubular contacts 3*b* of respective wire terminals 3 to electrically connect the wire terminals 3 to one another.

Figure 13:
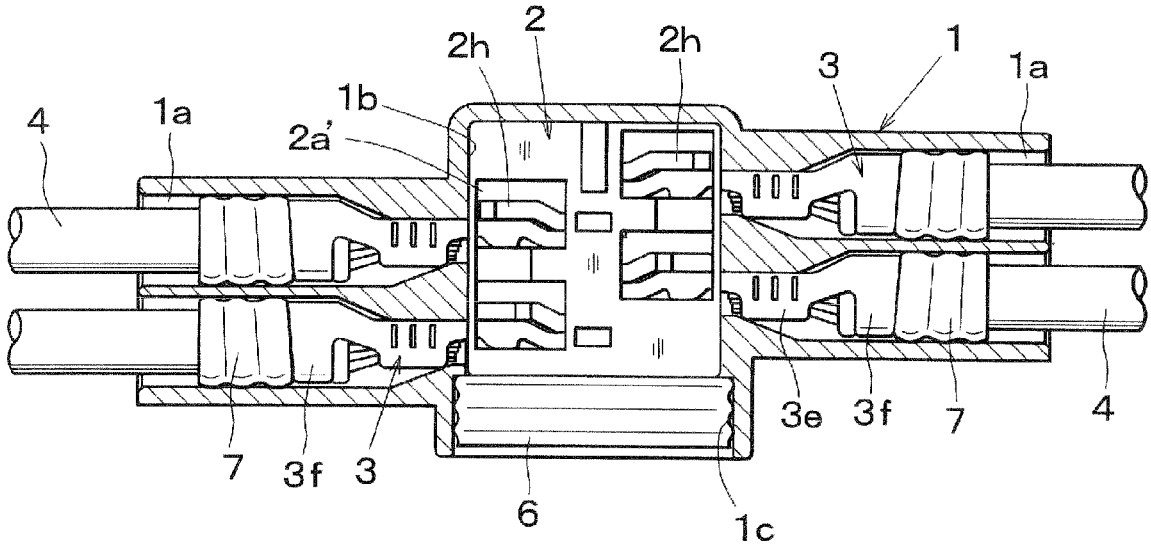
FIG. 13 is a side view of the harness connector, while only the outer holder is shown by a cross sectional view.

Next, when the waterproof member 6 is inserted into the opening 1*c* of the outer holder 1, the locking projections 2*d* of the inner holder 2 are inserted into the locking holes 6*b* of the waterproof member 6 and the waterproof member 6 is prevented from being removed from the outer holder 1. It should be noted that FIG. 13 is a cross sectional view showing only the outer holder 1 being in the same condition as that shown in FIG. 12.

Figure 14:
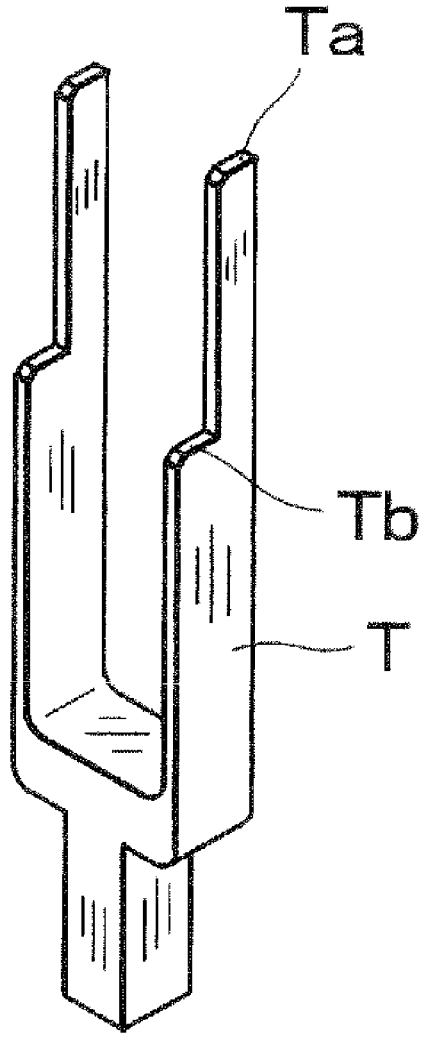
FIG. 14 is a perspective view illustrating a jig for removing the wire terminal.

FIG. 14 is a perspective view illustrating a jig T for pushing upward the operating tabs 2*k* of the inner holder 2 for removing the wire terminals 3 from the outer and inner holders 1 and 2. The jig T includes two end portions Ta and Tb. Since the two operating tabs 2*k* provided on the upper and lower movable supporting plates 2*h* are shifted horizontally, when the jig T is inserted into the inner holder 2, the two operating tabs 2*k* are simultaneously pushed upwardly by the two end portions Ta and Tb.

Figure 15:
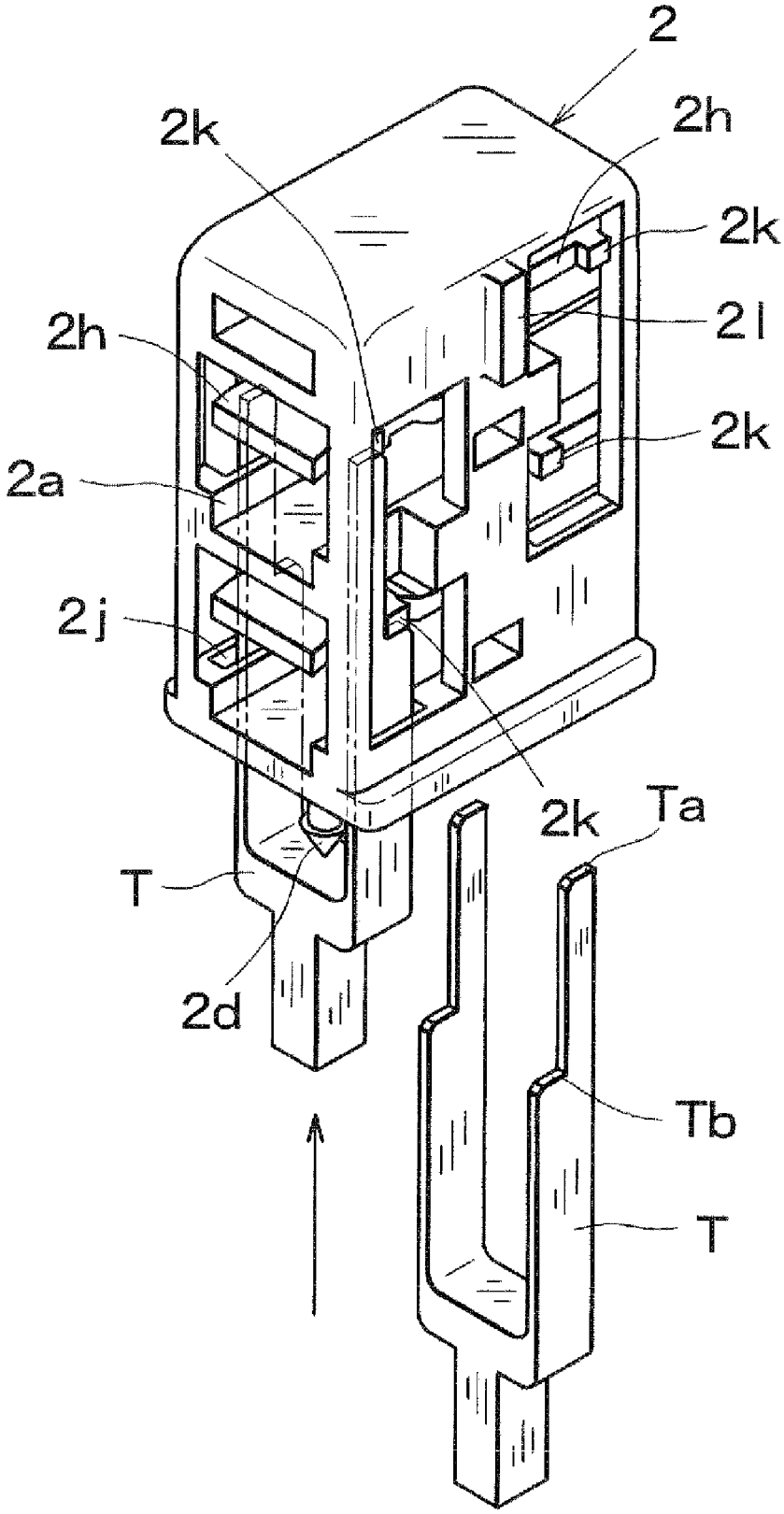
FIG. 15 is an explanatory figure for explaining the operation of the jig.

FIG. 15 is an explanatory drawing for explaining the operation of the jig T. In the drawing, the outer holder 1 and wire terminals 3 are not shown. At first, the waterproof member 6 and pin terminal 5 are removed from the outer and inner holders 1 and 2. Then, the jig T is inserted into the inner holder 2 through the slot portions 2*j* to push the operating tabs 2*k* of the movable supporting plates 2*h* upward. That is to say, the end portions Ta and Tb of the jig T are inserted into the slot portions 2*j* from the bottom through the opening 1*c* of the outer holder 1, and as shown in a left side of the drawing of FIG. 15, the upper and lower movable supporting plates 2*h* are simultaneously pushed upward via the operating tabs 2*k*, and the locking claws 2*i* are removed from the engaging holes 3*c* of the wire terminals 3. Then by pulling the electric wires 4, the two wire terminals 3 are simultaneously removed out of the inner holder 2. The remaining two wire terminals 3 may be pulled out of the inner holder 2 by inserting the jig T into the slot portions 2*j* formed on the other side of the inner holder 2.

In the third embodiment 3, the locking claws 2*j* are provided on the movable supporting plates 2*h* and the engaging holes 3*c* are formed in the wire terminals 3, but according to the invention, depressions may be formed in the movable supporting plates 2*h* and cooperating projections may be formed on the wire terminals 3.

In the above explained embodiments 1-3, the four wire terminal insertion openings 1*a* are formed in the outer holder 1 and the four wire terminals 3 are inserted into the outer holder 1, but according to the invention, wire terminal insertion openings more than or less than four may be provided. If one or more wire terminal insertion openings 3*a* are not closed by electric wires, they may be closed by inserting blind plugs made of a synthetic rubber to prevent undesired water penetration into the outer and inner holders 1 and 2.

Furthermore, in the above embodiments, the four wire terminal insertion openings 1*a* are formed in the outer holder 1 and the four wire terminals 3 are inserted into the outer holder 1, but according to the invention, wire terminal insertion openings more than or less than four may be formed in the outer holder 1.

The harness connector according to the invention can be advantageously used in harness circuits for automobiles.

What is claimed is:

1. A connection member comprising an outer holder having a plurality of wire terminal insertion openings and an inner holder insertion opening; an inner holder having wire terminal supporting holes and a pin terminal insertion hole; a pin terminal; and a waterproof member for sealing said inner holder insertion opening of the outer holder; whereby said wire terminal supporting holes are communicated with said wire terminal insertion openings and said pin terminal insertion hole is communicated with said wire terminal supporting holes within the inner holder under a condition that the inner holder is inserted into the outer holder through said inner holder insertion opening; and contacts provided in connecting portions of wire terminals inserted into said inner holder through said wire terminal insertion openings are brought into contact with the pin terminal by inserting the pin terminal into the pin terminal insertion hole and said wire terminals are electrically connected to one another.

2. The connection member according to claim 1, wherein said waterproof member has formed therein locking holes and said inner holder has formed thereon locking projections which are to be inserted into said locking holes such that said inner holder insertion opening of the outer holder is closed by the waterproof member.

3. The connection member according to claim 1, wherein said waterproof member is made of a synthetic rubber.

4. The connection member according to claim 1, wherein said waterproof member is secured to a closing member which is integrally formed with the outer holder via hinges, and said inner holder insertion opening is sealed with said waterproof member by closing said inner holder insertion opening by said closing member.

5. The connection member according to claim 4, wherein said waterproof member is made of a synthetic rubber.

6. The connection member according to claim 1, wherein said pin terminal is inserted into said pin terminal insertion hole through said inner holder insertion opening formed in the outer holder.

7. The connection member according to claim 6, wherein said waterproof member is made of a synthetic rubber.

8. The connection member according to claim 1, wherein said inner holder includes movable supporting plates for holding the wire terminals in the wire terminal insertion holes of the inner holder, and locking members for fixing the wire terminals in position are provided on said movable supporting plates.

9. The connection member according to claim 8, wherein said waterproof member is secured to a closing member which is integrally formed with the outer holder via hinges, and said inner holder insertion opening is sealed with said waterproof member by closing said inner holder insertion opening by said closing member.

10. The connection member according to claim 8, wherein said pin terminal is inserted into said pin terminal insertion hole through said inner holder insertion opening formed in the outer holder.

11. The connection member according to claim 8, wherein said waterproof member is made of a synthetic rubber.

12. The connection member according to claim 8, wherein said waterproof member has formed therein locking holes and said inner holder has formed thereon locking projections which are to be inserted into said locking holes such that said inner holder insertion opening of the outer holder is closed by the waterproof member.

13. The connection member according to claim 2, wherein said waterproof member is made of a synthetic rubber.

14. A harness connector comprising an outer holder having a plurality of wire terminal insertion openings and an inner holder insertion opening; an inner holder having wire terminal supporting holes and a pin terminal insertion hole and a pin terminal insertion hole, said wire terminal supporting holes being communicated with said wire terminal insertion openings under a condition that the inner holder is inserted into the outer holder through said inner holder insertion opening and said pin terminal insertion hole being communicated with said wire terminal supporting holes within the inner holder; wire terminals each having a tongue-like connecting portion formed at one end and an electric wire connected to the wire terminal at the other end, said connecting portion being inserted into the wire terminal supporting hole of the inner holder through the wire terminal insertion opening and a waterproof structure being attained between said wire terminal insertion opening and said electric wire by inserting the electric wire through a sealing member; a pin terminal which is brought into contact with contacts provided in the connecting portions of wire terminals inserted into said inner holder by inserting the pin terminal into the pin terminal insertion hole and said wire terminals are electrically connected to one another; and a waterproof member for sealing said inner holder insertion opening of the outer holder.

15. The harness connector according to claim 14, wherein each of said contacts of the wire terminals is formed by a short tubular contact extending in a direction perpendicular to a plane of the connecting portion.

16. A harness circuit for automobiles comprising the harness connector according to claim 14.

17. The harness connector according to claim 14, wherein said contacts of the wire terminals are inserted into the wire terminal supporting holes of the inner holder through the wire terminal insertion openings of the outer holder and said contacts are fixed in position onto the wire terminal supporting holes by locking the contacts with respect to the inner holder.

18. The harness connector according to claim 17, wherein each of said wire terminal supporting holes of the inner holder has formed therein a movable supporting plate for holding the wire terminal, and a locking portion is provided on said movable supporting plate such that said locking portion is engaged with a locking portion provided in the wire terminal.

19. The harness connector according to claim 18, wherein an operating tab is formed on a side wall of each of said movable supporting plates, and the movable supporting plate is moved by operating the operating tab such that locking portion of the movable supporting plate is disengaged from the locking portion of the wire terminal.

* * * * *